US006371139B1

(12) United States Patent
Simchori

(10) Patent No.: US 6,371,139 B1
(45) Date of Patent: Apr. 16, 2002

(54) BRACKET FOR FACILITATING DISPLACEMENT OF A PARASOL IN AN ARCUATE PATH

(76) Inventor: Dror Simchori, 6 Ben-Hillel Street, Ramat Aviv, Tel Aviv, 69021 (IL)

( * ) Notice: Subject to any disclaimer, the term of this patent is extended or adjusted under 35 U.S.C. 154(b) by 0 days.

(21) Appl. No.: 09/642,762

(22) Filed: Aug. 22, 2000

(51) Int. Cl.[7] ..... A45B 23/00

(52) U.S. Cl. ..... 135/20.1; 135/16; 52/158; 52/162; 248/156; 248/545; 297/184.16

(58) Field of Search ..... 52/155, 158, 162; 135/20.1, 27, 16; 248/156, 545, 546, 530; 297/184.16

(56) References Cited

U.S. PATENT DOCUMENTS

| | | | | | |
|---|---|---|---|---|---|
| 289,149 | A | * | 11/1883 | Scott | 248/546 |
| 2,163,808 | A | * | 6/1939 | Pithoud | 52/105 |
| 2,485,118 | A | | 10/1949 | Simpson | |
| 2,554,887 | A | * | 5/1951 | Tricarico | 248/545 |
| 2,559,421 | A | | 7/1951 | Garrett | |
| 2,863,466 | A | | 12/1958 | Small | |
| 2,905,187 | A | | 9/1959 | Croce | |
| 3,197,928 | A | * | 8/1965 | Frye | 52/157 |
| 3,486,514 | A | | 12/1969 | Prescott | |
| 4,109,322 | A | | 8/1978 | Ott | |
| 4,318,567 | A | * | 3/1982 | Guthier | 297/184 |
| 4,674,523 | A | | 6/1987 | Glatz | |
| 4,800,843 | A | * | 1/1989 | Wendling | 119/117 |
| 5,002,081 | A | | 3/1991 | Stromeyer | |
| 5,033,528 | A | | 7/1991 | Volcani | |
| 5,339,847 | A | | 8/1994 | Kanter et al. | |
| 5,396,916 | A | * | 3/1995 | Boissonnault | 135/16 |
| 5,878,762 | A | * | 3/1999 | Huang | 135/16 |
| 5,937,881 | A | | 8/1999 | Villa | |
| D414,053 | S | | 9/1999 | Ordelman | |
| 5,960,806 | A | | 10/1999 | Steiner | |
| 6,014,980 | A | | 1/2000 | Glatz | |

* cited by examiner

*Primary Examiner*—Beth A. Stephan
*Assistant Examiner*—Naoko Slack
(74) *Attorney, Agent, or Firm*—Mark M. Friedman

(57) ABSTRACT

A bracket for supporting a parasol and facilitating displacement of the parasol in an arcuate path includes a clamp configured for receiving and clamping a shaft of the parasol vertically, an arm, at least about ½ m long, connected to the bracket, and a vertical peg connected to the opposite end of the arm and configured for anchoring the bracket in an underlying surface.

12 Claims, 6 Drawing Sheets

BRACKET FOR FACILITATING DISPLACEMENT OF A PARASOL IN AN ARCUATE PATH

FIELD AND BACKGROUND OF THE INVENTION

The present invention relates to parasols and, in particular, it concerns a bracket for supporting a parasol and facilitating displacement of the parasol in an arcuate path.

Parasols are widely used to enhance comfort and to provide protection from the sun in a range of recreational contexts. The predominant design of parasol employs an umbrella-type structure supported on a vertical shaft which terminates at its lower end in a spike. The spike allows the parasol to be driven into soft surfaces, such as sand or earth, so that the parasol stands upright. For use on hard surfaces such as concrete, the shaft may be supported by a weighted (for example, water filled) base.

A significant problem associated with the use of parasols is the recurring need for repositioning of the parasol as the sun moves across the sky. A parasol correctly positioned to afford the user shade during the early morning hours may need to be repositioned frequently during the course of a day to correct for the varying angle of solar illumination. This typically requires significant exertion to uproot the spike from its previous position, to move the entire parasol, and to implant the spike firmly in its new position. More often, the user opts for the easier, although disruptive, option, to himself move, along with chairs, clothing, towels or other possessions, to the shifted newly-shaded region of the ground.

A number of adjustable sun-shade devices have been proposed to address the need for repositioning of the shade-giving element. Examples of such devices may be found in U.S. Pat. No. 2,905,187 to Croce, U.S. Pat. No. 3,486,514 to Prescott, U.S. Pat. No. 5,002,081 to Stromeyer, and U.S. Pat. No. 5,937,881 to Villa. Each of these devices, however, requires production of a modified parasol structure, resulting in increased costs and, in most cases, a larger and heavier structure which is not readily transportable.

There is therefore a need for a bracket for supporting a parasol of conventional design which would facilitate displacement of the parasol to accommodate changes in the position of the sun in the sky.

SUMMARY OF THE INVENTION

The present invention is a bracket for supporting a parasol and facilitating displacement of the parasol in an arcuate path.

According to the teachings of the present invention there is provided, a bracket for supporting a parasol and facilitating displacement of the parasol in an arcuate path, the parasol having a vertical shaft supporting a shade-providing element, the bracket comprising: (a) a clamp configured for receiving and clamping the vertical shaft of the parasol in a substantially vertical orientation; (b) a substantially horizontal arm having a first end connected to the bracket and a second end distanced from the first end by at least about 40 cm; and (c) an anchoring configuration associated with the second end of the arm and configured for anchoring the bracket in an underlying surface so as to define an anchoring position, the anchoring configuration being configured to allow rotation of the arm about a substantially vertical axis passing through the anchoring position.

According to a further feature of the present invention, the clamp is implemented as a hollow cylinder with at least one adjustable clamping element.

According to a further feature of the present invention, the clamp has a lower end provided with an outwardly projecting flange configured to provide supplementary support by contact with the underlying surface.

According to a further feature of the present invention, the clamp is configured to allow vertical adjustment of a clamping position of the vertical shaft of the parasol between a first position in which the vertical shaft extends downwards below the clamp and a second position in which the vertical shaft does not extend below the clamp.

According to a further feature of the present invention, the arm includes an adjustable telescopic structure configured to allow adjustment of a distance between the first end and the second end.

According to a further feature of the present invention, the anchoring configuration is implemented as a substantially vertical peg connected to the second end of the arm and configured for implanting into the underlying surface.

According to a further feature of the present invention, the peg is provided with a self-drilling threaded screw structure for facilitating anchoring of the bracket into the underlying surface.

According to a further feature of the present invention, the anchoring configuration includes: (a) a base configured for non-rotating engagement with the underlying surface; and (b) a rotatable coupling for supporting the arm relative to the base in such a manner as to allow the rotation of the arm about the substantially vertical axis.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
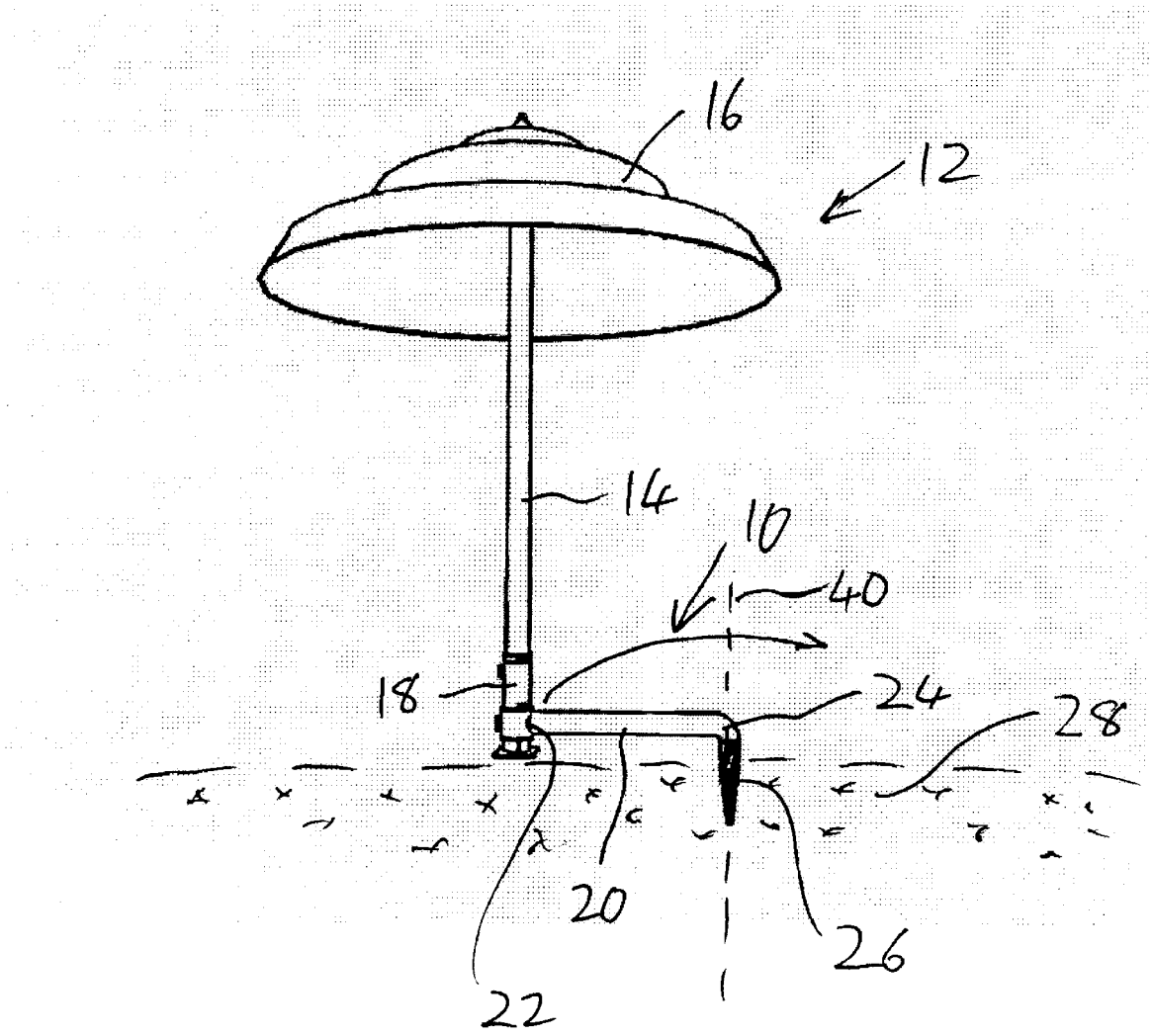
FIG. 1 is a perspective view of a parasol supported by a bracket, constructed and operative according to the teachings of the present invention.
Figure 2:
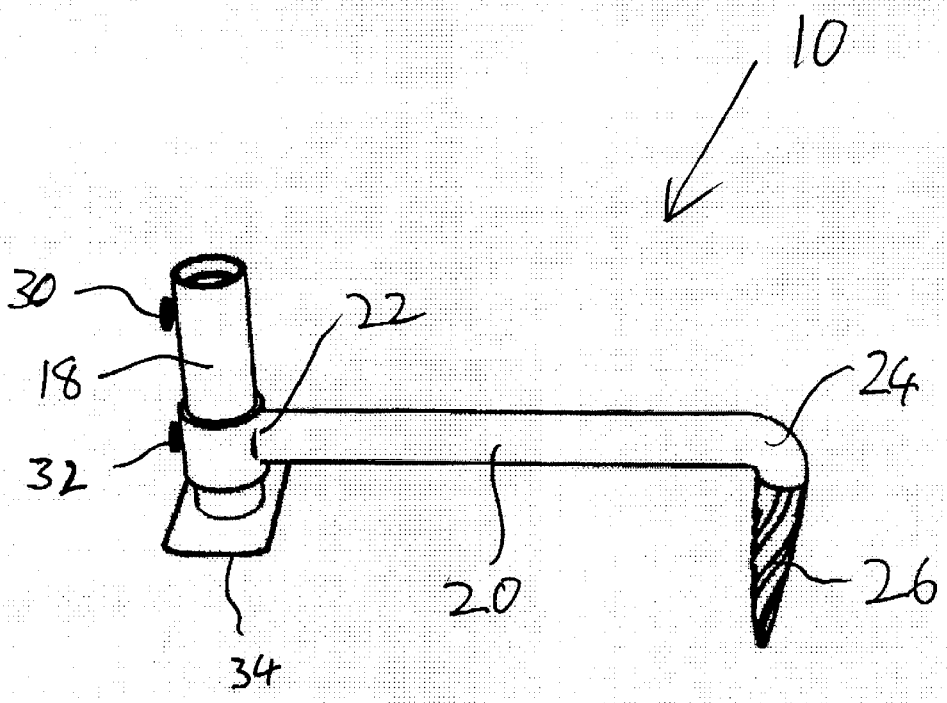
FIG. 2 is a first enlarged perspective view of the bracket of FIG. 1.
Figure 3:
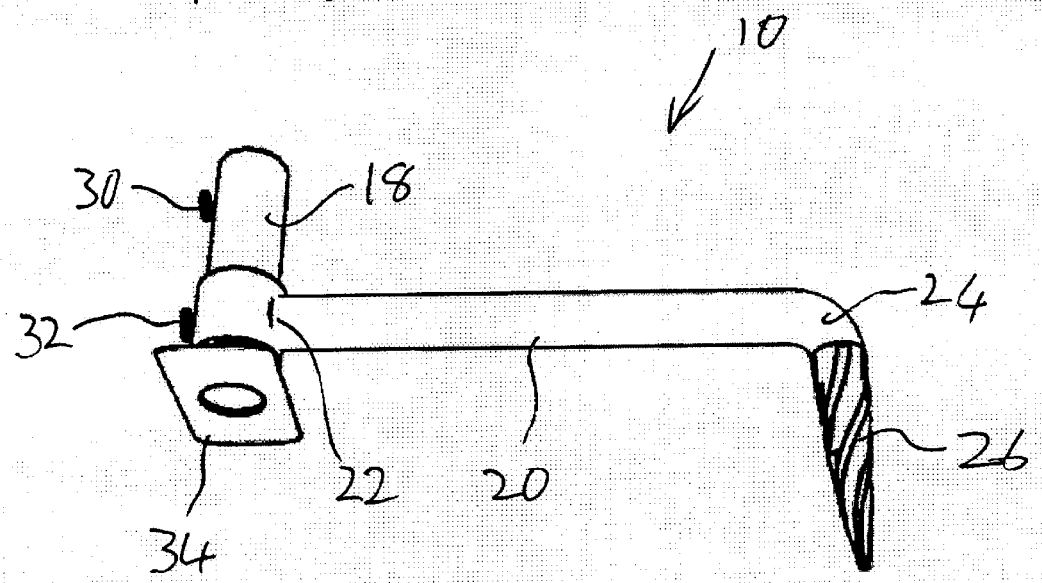
FIG. 3 is a second enlarged perspective view of the bracket of FIG. 1.

The present invention is a bracket for supporting a parasol and facilitating displacement of the parasol in an arcuate path.

The principles, and operation of brackets according to the present invention may be better understood with reference to the drawings and the accompanying description.

Referring now to the drawings, FIGS. 1–6 show a bracket, generally designated 10, constructed and operative according to the teachings of the present invention, for supporting a parasol 12 having a vertical shaft 14 supporting a shade-providing element 16.

Generally speaking, bracket 10 features a clamp 18 configured for receiving and clamping vertical shaft 14 in a substantially vertical orientation, a substantially horizontal arm 20 having a first end 22 connected to bracket 18 and a second end 24 distanced from first end 22 by at least about 40 cm. An anchoring configuration 26, associated with second end 24, is configured for anchoring bracket 10 in an underlying surface 28 so as to define an anchoring position. Anchoring configuration 26 is configured to allow rotation of arm 20 about a substantially vertical axis 40 passing through the anchoring position.

It will be readily appreciated that the bracket of the present invention provides a particularly simple, cheap and effective solution to the repositioning of a parasol to accommodate the movement of the sun across the sky. Specifically, by providing an anchor position horizontally removed from the vertical shaft of the parasol, the parasol may readily be moved through an arcuate (circular) motion about axis 40 without uprooting the anchoring configuration and without the user needing to support the weight of the parasol. This circular path is highly suited to following the path of the sun across the sky during a large proportion of the day. The bracket is itself a relatively small, transportable element which may be used together with almost any conventional parasol.

Turning now to the features of bracket 10 in more detail, clamp 18 is preferably implemented as a hollow cylinder with at least one adjustable clamping element, such as clamping bolt 30. Preferably, clamp 18 features an outwardly projecting flange 34 at its lower end configured to provide supplementary support by contact with the underlying surface. A second clamping bolt 32 preferably facilitates adjustment of the relative vertical position of clamp 18 relative to arm 20, thereby allowing flange 34 to be raised or lowered (see position 34' shown in FIG. 4) to accommodate variations in alignment with the ground.

As also illustrated by dashed lines in FIG. 4, clamp 18 is preferably configured to allow vertical adjustment of a clamping position of vertical shaft 14 between a first position pi in which shaft 14 extends downwards below the clamp and a second position P2 in which shaft 14 does not extend below the clamp. The shaft is typically used in the raised position, being lowered to the lower position when additional support is desired, such as in windy conditions, so that the spike of the parasol may be sunk into the underlying ground to provide extra support.

Turning now to arm 20, this preferably has a length in the range from bout 40 cm to about 90 cm, and most preferably between about 50 cm and about 70 cm. However, it should be noted that the preferred length is a function of factors such as the latitude at which the bracket is to be used and the dimensions of the parasol with which it is to be used, and may vary outside of these ranges.

Figure 4:
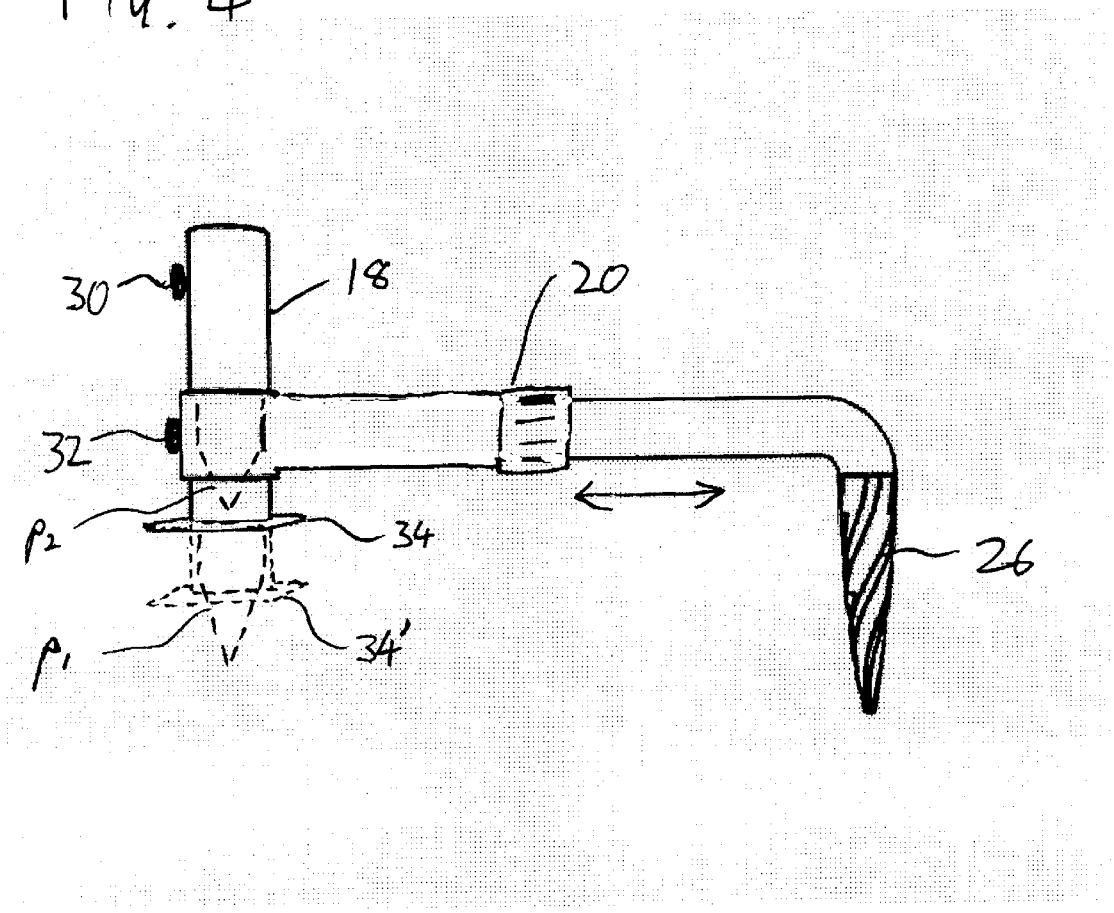
FIG. 4 is a side view of a variation of the bracket of FIG. 1 showing a telescopic adjustment option.

Optionally, as illustrated in FIG. 4, arm 20 includes an adjustable telescopic structure configured to allow adjustment of the length of the arm. This preferably provides an option for further extending the range of motion for use in the early morning or late evening when the sun is low in the sky. The capability of linear extension by use of a telescopic structure provides additional functionality in situations where lack of space or other factors preclude the normal swinging adjustment motion. Finally, a shortened telescopic structure provides for reducing the radius of motion below the aforementioned normal values for use in tropical latitudes where a large arcuate motion may be less effective for following the trajectory of the sun.

In a particularly simple and cost effective preferred implementation, the anchoring configuration is implemented as a substantially vertical peg 26, connected to second end 24, as shown in FIGS. 1–4. Peg 26 is preferably provided with a self-drilling threaded screw structure for facilitating anchoring of the bracket into the underlying surface.

As mentioned earlier, parasols may be supported over hard surfaces by inserting them into a suitable cylindrical socket in a weighted base, such as a water-filled, sand-filled or concrete block. It should be noted that bracket 10 may be used to advantage with peg 26 inserted into such a base to provide an arcuate adjustment motion according to the teachings of the present invention.

Figure 5:
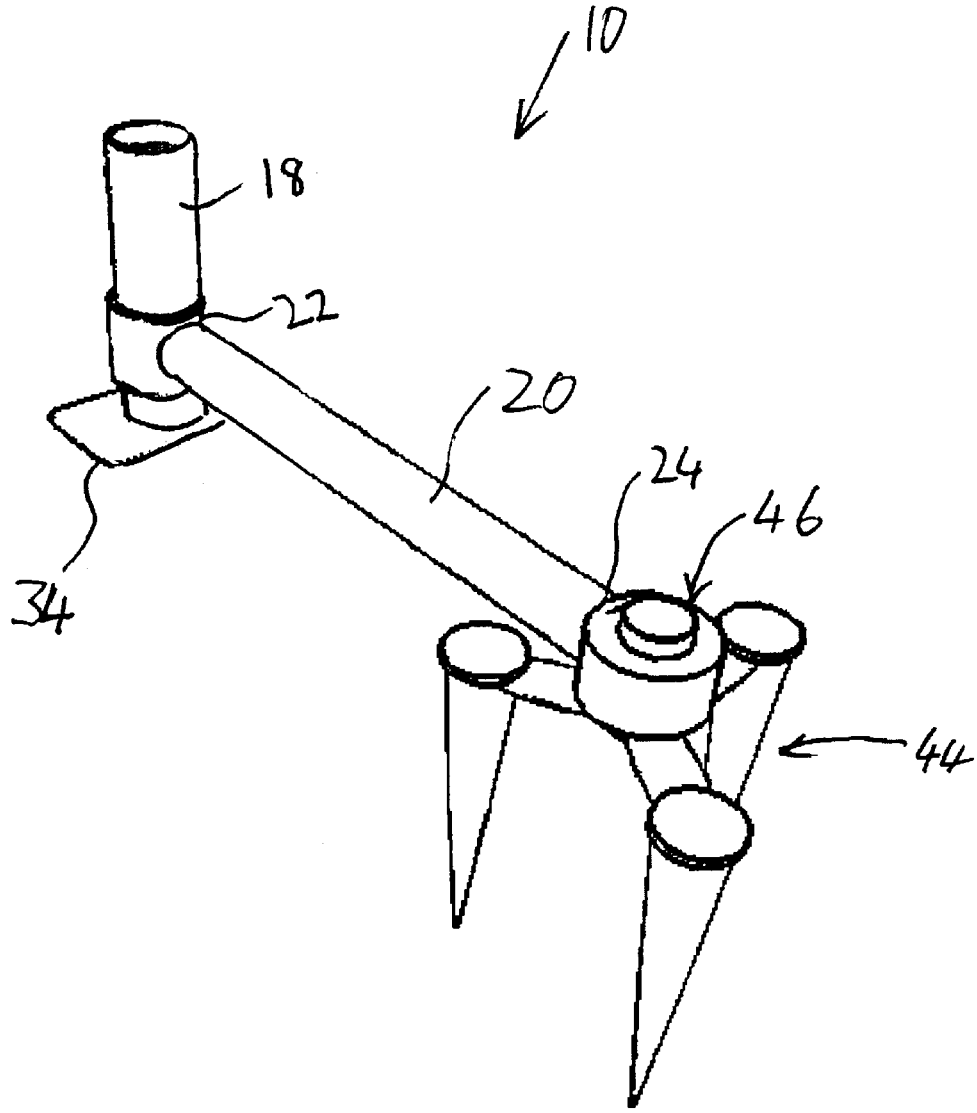
FIG. 5 is a variant implementation of the bracket of FIG. 1.

In an alternative implementation, as shown in FIG. 5, the anchoring configuration includes a base 44 configured for non-rotating engagement with the underlying surface. A rotatable coupling 46 supports arm 20 relative to base 44 so as to allow rotation of arm 20 about axis 40. Base 44 is preferably implemented using at least two, and in this preferred case three, pegs to achieve a firm non-rotating engagement with the underlying surface (such as sand or soil).

The presence of rotatable coupling 46 may optionally be used to advantage for certain additional features. For example, a drive mechanism may be associated with the coupling (preferably housed therewithin) configured to automatically rotate arm 20 at a suitable angular rate (constant or gradually varying) throughout the day, thereby automatically following the sun's path.

Figure 6:
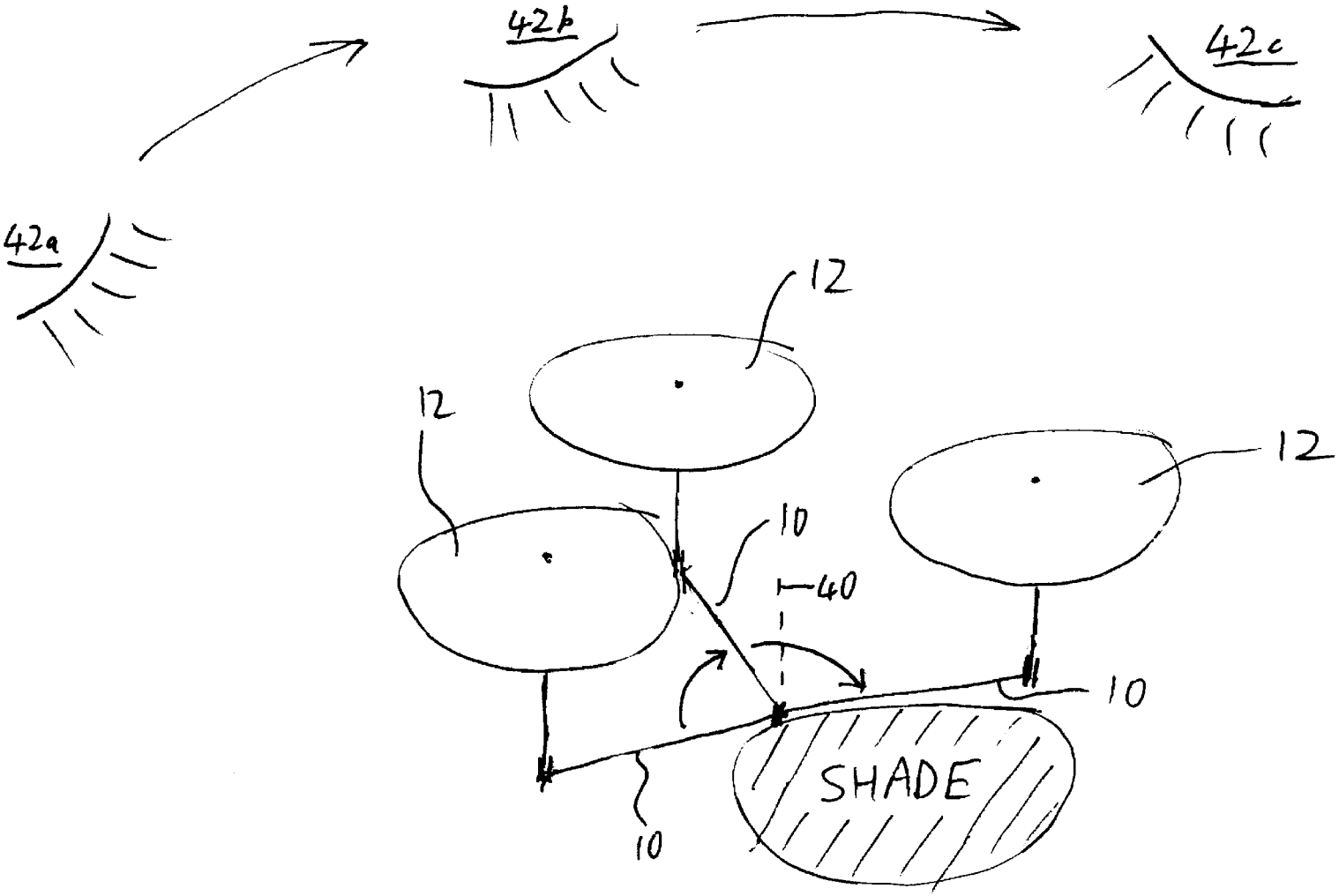
FIG. 6 is a schematic representation of the bracket of FIG. 1 in use.

Turning finally to FIG. 6, this illustrates the operation of bracket 10. The bracket is initially aligned such that anchoring configuration 26 provides an axis of rotation 40 appropriate for following the expected path of the sun. As a first approximation, the bracket may be positioned on the near side of the parasol along a line from the user to the position of the sun. The bracket is then swung about its anchor position during the course of the day as needed, shaft 14 being lowered to provide additional support if required. FIG. 6 shows the bracket in three successive angular positions, suited to the three positions of the sun in the sky represented by 42*a*, 42*b* and 42*c*, respectively. In each position, the location of the patch of shade remains substantially unchanged.

It will be appreciated that the above descriptions are intended only to serve as examples, and that many other embodiments are possible within the spirit and the scope of the present invention.

What is claimed is:

1. A bracket for supporting a parasol and facilitating displacement of the parasol in an arcuate path, the parasol having a vertical shaft supporting a shade-providing element, the bracket comprising:

(a) a clamp configured for receiving and clamping the vertical shaft of the parasol in a substantially vertical orientation;

(b) a substantially horizontal arm having a first end connected to said bracket and a second end distanced from said first end by at least about 40 cm; and (c) an anchoring configuration including:

(i) a base configured for non-rotating engagement with the underlying surface so as to anchor the bracket in an underlying surface, and (ii) a rotatable coupling associated with said second end of said arm and configured for supporting said arm relative to said base in such a manner as to allow rotation of said arm about a substantially vertical axis passing through said anchoring configuration.

2. The bracket of claim 1, wherein said clamp is implemented as a hollow cylinder with at least one adjustable clamping element.

3. The bracket of claim 1, wherein said clamp has a lower end provided with an outwardly projecting flange configured to provide supplementary support by contact with the underlying surface.

4. The bracket of claim 1, wherein said clamp is configured to allow vertical adjustment of a clamping position of the vertical shaft of the parasol between a first position in which the vertical shaft extends downwards below said clamp and a second position in which said vertical shaft does not extend below said clamp.

5. The bracket of claim 1, wherein said arm includes an adjustable telescopic structure configured to allow adjustment of a distance between said first end and said second end.

6. A bracket for supporting a parasol and facilitating displacement of the parasol in an arcuate path, the parasol having a vertical shaft supporting a shade-providing element, the bracket comprising:

(a) a clamp configured for receiving and clamping the vertical shaft of the parasol in a substantially vertical orientation;

(b) a substantially horizontal arm having a first end connected to said bracket and a second end distanced from said first end by at least about 40 cm; and (c) an anchoring configuration associated with said second end of said arm and configured for anchoring the bracket in an underlying surface, said anchoring configuration being configured to allow rotation of said arm about a substantially vertical axis passing through said anchoring configuration;

wherein said clamp is configured to allow vertical adjustment of a clamping position of the vertical shaft of the parasol between a first position in which the vertical shaft extends downwards below said clamp and a second position in which said vertical shaft does not extend below said clamp.

7. The bracket of claim 6, wherein said clamp is implemented as a hollow cylinder with at least one adjustable clamping element.

8. The bracket of claim 6, wherein said clamp has a lower end provided with an outwardly projecting flange configured to provide supplementary support by contact with the underlying surface.

9. The bracket of claim 6, wherein said arm includes an adjustable telescopic structure configured to allow adjustment of a distance between said first end and said second end.

10. The bracket of claim 6, wherein said anchoring configuration is implemented as a substantially vertical peg connected to said second end of said arm and configured for implanting into the underlying surface.

11. The bracket of claim 10, wherein said peg is provided with a self-drilling threaded screw structure for facilitating anchoring of the bracket into the underlying surface.

12. The bracket of claim 6, wherein said anchoring configuration includes:

(a) a base configured for non-rotating engagement with the underlying surface; and (b) a rotatable coupling for supporting said arm relative to said base in such a manner as to allow said rotation of said arm about said substantially vertical axis.

* * * * *

UNITED STATES PATENT AND TRADEMARK OFFICE

CERTIFICATE OF CORRECTION

PATENT NO. : 6,371,139 B1
DATED : April 16, 2002
INVENTOR(S) : Simchoni

It is certified that error appears in the above-identified patent and that said Letters Patent is hereby corrected as shown below:

Title page,
Item [76], please amend the inventor's name to show -- Simchoni -- and not "Simchori".

Signed and Sealed this

Third Day of September, 2002

*Attest:*

*Attesting Officer*

JAMES E. ROGAN
*Director of the United States Patent and Trademark Office*